US006050683A

United States Patent [19]

Nuita et al.

[11] Patent Number: 6,050,683

[45] Date of Patent: Apr. 18, 2000

[54] INK-JET PRINTER HAVING FRONT-END CLAMPING SECTION WHICH ENABLES MOTION OF A REAR-END CLAMPING SECTION

[75] Inventors: Akira Nuita, Shizuoka-ken; Shinichiro Fujii, Mishima, both of Japan

[73] Assignee: Toshiba Tec Kabushiki Kaisha, Tokyo, Japan

[21] Appl. No.: 09/048,590

[22] Filed: Mar. 26, 1998

[30] Foreign Application Priority Data

Mar. 28, 1997 [JP] Japan ..... 9-076839

[51] Int. Cl.[7] ..... B41J 2/01; B65H 5/02

[52] U.S. Cl. ..... 347/104; 271/276

[58] Field of Search ..... 347/104, 105, 347/248, 215; 101/408, 409; 271/275, 276, 277, 188; 400/629; 399/388, 397, 398

[56] References Cited

U.S. PATENT DOCUMENTS

| | | | |
|---|---|---|---|
| 4,660,825 | 4/1987 | Umezawa | 271/276 |
| 5,159,352 | 10/1992 | Ferla et al. | 347/248 |
| 5,186,107 | 2/1993 | Wieland | 101/409 |

FOREIGN PATENT DOCUMENTS

| | | |
|---|---|---|
| 0 355 005 A2 | 2/1990 | European Pat. Off. . |
| 0 518 674 A1 | 12/1992 | European Pat. Off. . |
| 61-185475 | 8/1986 | Japan . |

*Primary Examiner*—Arthur T. Grimley
*Assistant Examiner*—Hoan Tran
*Attorney, Agent, or Firm*—Frishauf, Holtz, Goodman, Langer & Chick, P.C.

[57] ABSTRACT

An ink-jet printer includes a rotary drum which rotates at a constant speed; a medium holding system which holds a printing medium on the rotary drum; and a print head which prints an image by jetting ink onto a printing medium which is held on the rotary drum by the medium holding system and which rotates along with the rotary drum, while the rotary drum makes a predetermined number (greater than one) of rotations during a printing operation. The medium holding system includes a front-end clamping section, on the peripheral surface of the rotary drum, for clamping a front end of the printing medium; a rear-end clamping section set apart from the front-end clamping section in a rotational direction of the rotary drum along the peripheral surface of the rotary drum, for clamping a rear end of the printing medium; and a driving section for driving the front-end clamping section and the rear-end clamping section to clamp the printing medium on the peripheral surface of the rotary drum during one rotation of the rotary drum made before printing of the image is initiated and to release the printing medium from the peripheral surface of the rotary drum during another rotation of the rotary drum made after printing of the image is completed. A motion of the rear-end clamping section is mechanically enabled by a motion of the front-end clamping section after the rotary drum rotates by an amount which corresponds to a distance between the front-end and rear-end clamping sections.

4 Claims, 9 Drawing Sheets

INK-JET PRINTER HAVING FRONT-END CLAMPING SECTION WHICH ENABLES MOTION OF A REAR-END CLAMPING SECTION

BACKGROUND OF THE INVENTION

This invention relates to an ink-jet printer which performs printing by jetting ink onto a sheet of paper held on a rotary drum as a printing medium.

Recently, personal computers of high performance and low cost have been readily available, and are widely spreading rapidly. With this spread, demands for color printers also increase. For personal use, various types of ink-jet printers have been developed for color printing.

Conventionally, for example, an ink-jet printer capable of printing 500 sheets or more continuously is known. The ink-jet printer includes a rotary drum which rotates at a constant circumferential speed and a print head for jetting color inks onto a paper sheet held on the peripheral surface of the rotary drum. The paper sheet is loaded on the rotary drum from the front side thereof and printed in a state wound around the rotary drum. After printing, the paper sheet is removed from the drum and discharged to the rear side of the rotary drum.

The print head includes nozzle units arranged along the peripheral surface of the rotary drum to print an image in yellow, cyan, magenta and black, for example. Each nozzle unit has a plurality of ink-jet nozzles aligned across the paper sheet in the main scanning direction parallel to the axis of the rotary drum and jets ink from the ink-jet nozzles to print an image over all the paper sheet while the paper sheet moves in the sub-scanning direction perpendicular to the main scanning direction with the rotation of the drum.

The above-described conventional ink-jet printer requires a long printing time to perform continuous printing. The rotation of the drum stops each time the paper sheet is loaded thereto or removed therefrom, so as to prevent a print head from being damaged due to a rise of the paper sheet. It is considered that the printing time can be shortened, for example, by increasing the rotational speed of the rotary drum. However, this makes it difficult to quickly stabilize the rotational speed of the drum, and also increases the load on a motor for driving the drum. In light of these reasons, an increase in the rotational speed of the drum is restricted.

BRIEF SUMMARY OF THE INVENTION

An object of the invention is to provide an ink-jet printer in which a printing medium can be securely held on a rotary drum rotating at a constant speed during the printing to obtain excellent printing quality.

Another object of the invention is to provide an ink-jet printer which can prevent a print head from being damaged by a printing medium held on and removed from a rotary drum rotating at a constant speed.

According to the invention, there is provided an ink-jet printer which comprises a rotary drum for rotating at a constant speed; a medium holding system for holding the printing medium on the rotary drum while the rotary drum is rotating; a print head for printing an image by jetting ink onto a printing medium which is held on the rotary drum by the medium holding system and rotates along with the rotary drum; wherein the medium holding system includes a front-end clamping section, disposed on the peripheral surface of the rotary drum, for clamping a front end of the printing medium; a rear-end clamping section set apart from the front-end clamping section in a rotational direction of the rotary drum along the peripheral surface of the rotary drum, for clamping a rear end of the medium; and a driving section for driving the front-end clamping section and the rear-end clamping section to hold the printing medium on the peripheral surface of the rotary drum and stopping the driving of the front-end clamping section and the rear-end clamping section to remove the printing medium from the peripheral surface of the rotary drum; and the driving section is constituted such that a motion of the front-end clamping section is required as a condition for enabling a motion of the rear-end clamping section and the motions of the front end and rear-end clamping sections are synchronized to have a predetermined difference in the rotation amount of the rotary drum which corresponds to a distance between the front-end and rear-end clamping sections.

In the ink-jet printer, the front-end clamping section is disposed on the peripheral surface of the rotary drum to clamp the front end of a printing medium, and the rear-end clamping section is set apart from the front-end clamping section in the rotational direction along the peripheral surface of the rotary drum to clamping the rear end of the printing medium. The driving section drives the front-end clamping section and the rear-end clamping section to hold the printing medium on the peripheral surface of the rotary drum and stopping the driving of the front-end clamping section and the rear-end clamping section to remove the printing medium from the peripheral surface of the rotary drum. The driving section is constituted such that a motion of the front-end clamping section is required as a condition for enabling a motion of the rear-end clamping section and the motions of the front end and rear-end clamping sections are synchronized to have a predetermined difference in the rotation amount of the rotary drum which corresponds to a distance between the front-end and rear-end clamping sections. In other words, the rotary drum does not need to be stopped in order to reliably and securely hold the printing medium on the peripheral surface of the rotary drum. Accordingly, the printing time can be shortened without limitations which may occur when rotation and stop of the rotary drum are repeated. Moreover, since the clamp operation of the rear-end clamping section prevents the rear portion of the printing medium from rising from the peripheral surface of the drum during its rotation and contacting the print head. Thus, the print head would not be damaged by the printing medium.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An ink-jet printer according to one embodiment of the invention will now be described with reference to accompanying drawings.

The ink-jet printer is used for multi-color printing on a paper sheet M cut as a printing medium. The paper sheet M can be, for example, a plain paper or an OHP sheet.

Figure 1:
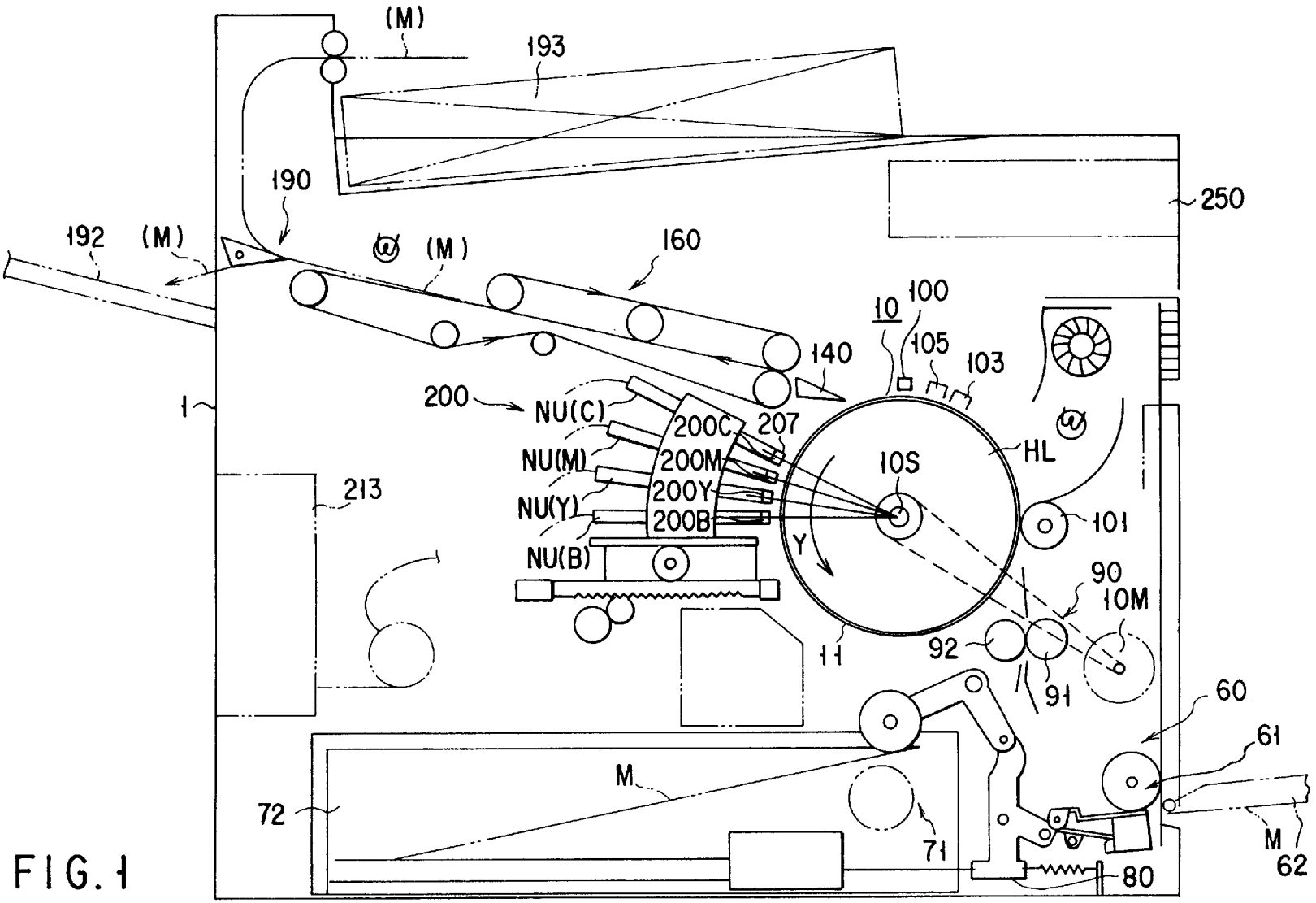
FIG. 1 is a view showing the internal structure of an ink-jet printer according to the embodiment of the invention.

FIG. 1 shows the internal structure of this ink-jet printer. The ink-jet printer comprises a rotary drum 10 for rotating at a constant circumferential speed while holding the paper sheet M, a print head 200 for performing multi-color printing for the paper sheet M rotating together with the rotary drum 10, a manual feed tray 62 for supporting each paper sheet M inserted one by one, a paper cassette 72 for storing a stack of paper sheets M inserted, a sheet feed-in mechanism 60 for feeding each paper sheet M from the paper cassette 72 and the manual feed tray 62 to the rotary drum 10, a sheet feed-out mechanism 160 for feeding out the paper sheet M printed at the rotary drum 10, and a control unit 250 for controlling the whole operation of the ink-jet printer. As shown in FIG. 1, the rotary drum 10 is arranged near the center position in a housing 1. The tray 62 is arranged to be turned over outwardly from the front portion of the housing 1 located at a position lower than the rotary drum 10. The paper cassette 72 is arranged below the rotary drum 10. The sheet feed-in mechanism 60 is arranged between the manual feed tray 62 and the paper cassette 72. The print head 200 is arranged behind the rotary drum 10. The sheet feed-out mechanism 160 is arranged above the print head 200 behind the rotary drum 10.

The rotary drum 10 is rotatably supported by a shaft 10S serving as a center axis and has a sheet holding system HL for holding the paper sheet M wound on the peripheral surface 11 with rotation of the rotary drum 10. The rotational position of the rotary drum 10 is detected by a rotational position sensor 100 disposed near the peripheral surface of the rotary drum 10. The print head 200 comprises four nozzle units NU, which are arranged corresponding to color inks, e.g., cyan, magenta, yellow and black, along the peripheral surface 11 of the rotary drum 10 to perform printing for the paper sheet M with cyan, magenta, yellow, and black inks, and receive these color inks from ink supply sections 213 arranged apart from the print head 200. Each nozzle unit NU has a plurality of ink-jet nozzles 207 aligned in the axial direction of the rotary drum 10 to eject a corresponding color ink on the paper sheet M. The ink-jet nozzles 207 are arranged to have a length corresponding to 210 mm, which is the width of the paper sheet M of the A4 size. The sheet feed-in mechanism 60 has a sheet loader 90 for loading the paper sheet M to the rotary drum 10 such that the width direction of the paper sheet M coincides with the axial direction of the rotary drum 10, a manual feeder 61 for picking up the paper sheet M from the manual feed tray 62 and feeding the paper sheet M to the sheet loader 90, a cassette feeder 71 for picking up the paper sheet M from the paper cassette 72 and feeding the paper sheet M to the sheet loader 90, and a feeder switching section 80 for driving one of the manual feeder 61 and the cassette feeder 71. The sheet loader 90 is controlled to load the paper sheet M to the rotary drum 10 when the position sensor 100 detects that the rotary drum 10 has reached a predetermined position by rotation. The paper sheet M is held by the sheet holding system HL on the peripheral surface 11 of the rotary drum 10. The print head 200 performs color printing for the paper sheet M during rotation of the rotary drum 10.

After printing, the paper sheet M is removed from the peripheral surface 11 of the rotary drum 10 by a sheet separator 140 and fed in a preset direction by the sheet feed-out mechanism 160. The sheet separator 140 is a separation claw to be in contact with the rotary drum 10 at the time of removing the paper sheet M. A discharge switch 190 selectively guides the paper sheet M to one of a rear discharge tray 192 for discharging with a printing surface facing upward or an upper discharge tray 193 for discharging the paper sheet M with a printing surface facing downward.

The print head 200 can be slightly shifted forward and backward in the main scanning direction X parallel to the axial direction of the rotary drum 10, and can be moved between a printing position adjacent to the peripheral surface 11 of the rotary drum 10 and a standby position remote from the printing position.

The rotary drum 10 carries the paper sheet M wound around the peripheral surface 11 thereof, and rotates to move the paper sheet M in the sub-scanning direction Y perpendicular to the main scanning direction X in a state facing to the nozzle units NU. The rotary drum 10 is maintained at a constant revolution number of, e.g., 120 rpm and rotates one revolution every 0.5 second in order to achieve multi-color printing of 20 paper sheets per minute, for example. In the printing operation, the nozzle unit NU is shifted in the main scanning direction X at a constant rate of a ¼ nozzle pitch PT each time the rotary drum 10 rotates one revolution so that it moves by a distance equal to the nozzle pitch PT while the rotary drum 10 rotates four revolutions. In this configuration, printing of the entire surface of the paper sheet M can be completed within two seconds (=0.5 second× 4) required to rotate the rotary drum 10 through four revolutions. Even considering a time required to rotate the rotary drum 10 through two revolutions each for winding up a paper sheet before printing and for removing the paper sheet after printing, multi-color printing can be performed for one A4 size paper sheet M at a high speed of 3 (=2+1) seconds per paper sheet. Therefore, 20 paper sheets can be printed continuously per minute.

The sheet loader 90 comprises at least one pair of loading rollers 91 and 92 extending in the axial direction of the rotary drum 10 and is used to load each paper sheet M fed from the feeder 61 and 71 sides to the rotary drum 10 side at a predetermined timing. The supply speed of the paper sheet M is set at a speed corresponding to the circumferential speed of the rotary drum 10.

At least one of the loading rollers 91 and 92 receives a rotating force applied from a main motor 10M constituting a feed force applying section together with a gear train, a clutch, and the like. The main motor 10M drives the loading rollers 91 and 92 under the control of the control unit 250, and feeds the paper sheet M to the rotary drum 10 side. The rotary drum 10 is rotated by the driving force of the main motor 10M transmitted to the shaft 10S via timing belts and gears. The main motor 10M is constituted by a servo motor, which has excellent quick-response and constant-speed characteristics. Since the diameter of the rotary drum 10 is set at 130 mm, a circumferential speed of 816 mm/sec=120 πd/60 is obtained. The peripheral surface 11 of the rotary drum 10 has a width of about 220 mm in the axial direction, and a length of 408 mm (=πd) in the rotational direction. Therefore, the rotary drum 10 can satisfactorily hold an A4 size paper sheet M having a length of 297 mm and a width of 210 mm.

Figure 2:
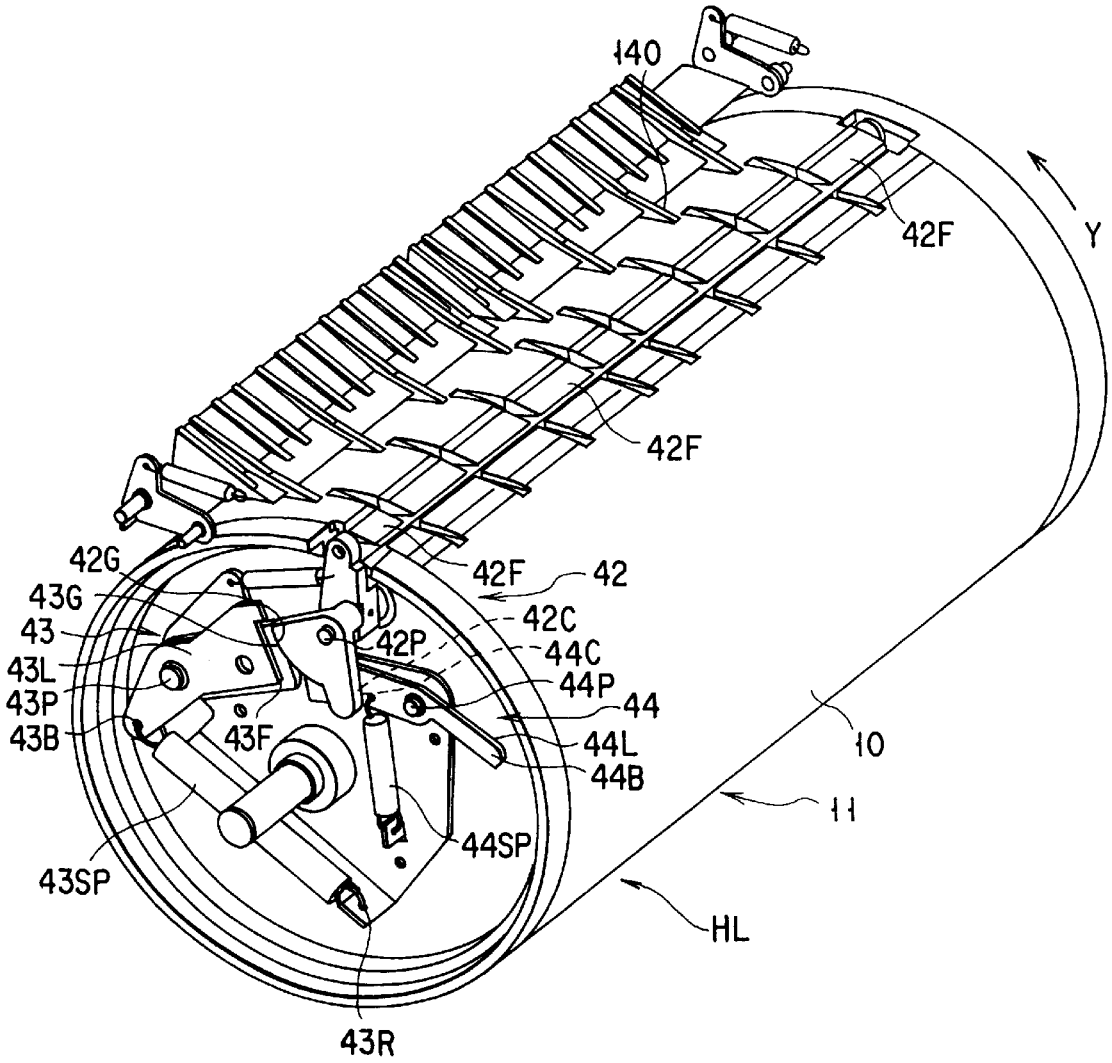
FIG. 2 is a perspective view showing the outer appearance of a rotary drum shown in FIG. 1.
Figure 3:
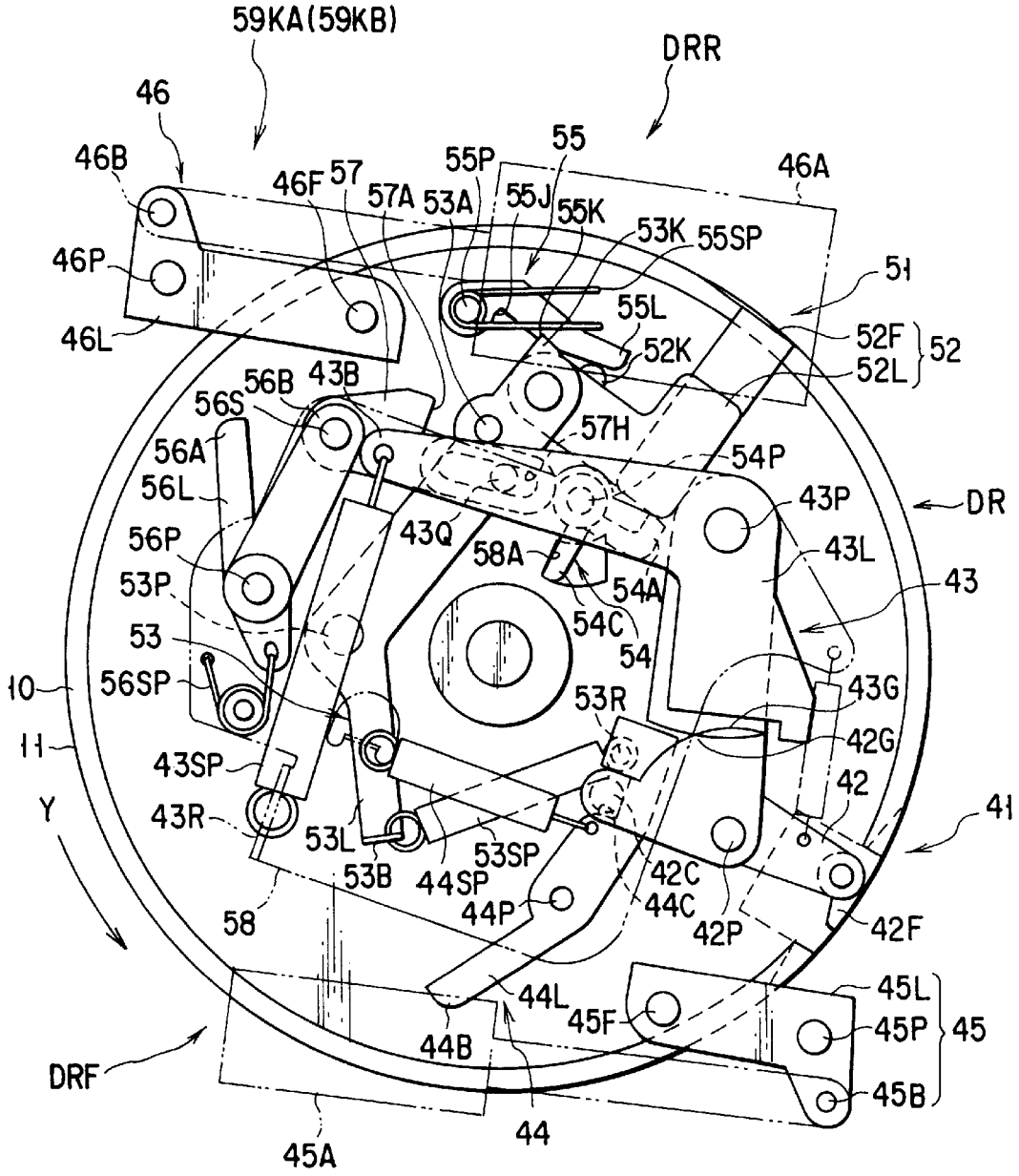
FIG. 3 is a view showing the detailed structure of a sheet holding system incorporated in the rotary drum shown in FIG. 2.

FIG. 2 shows the outer appearance of the rotary drum 10. FIG. 3 shows the detailed structure of the sheet holding system HL incorporated in the rotary drum 10 shown in FIG. 2. The sheet holding system HL is constituted so as to mechanically hold a paper sheet M on the peripheral surface of the rotary drum 10. Specifically, the sheet holding system HL includes a front-end clamping section 41, disposed on the peripheral surface of the rotary drum, for clamping a front end of a paper sheet M loaded from the sheet loader 90; a rear-end clamping section 51 set apart from the front-end clamping section in a rotational direction of the rotary drum along the peripheral surface of the rotary drum by a distance corresponding to the length of the paper sheet M, for clamping a rear end of the paper sheet M loaded from the sheet loader 90; and a driving section DR for driving the front-end clamping section 41 and the rear-end clamping section 51 to hold the paper sheet M on the peripheral surface of the rotary drum 10 and stopping the driving of the front-end clamping section 41 and the rear-end clamping section 51 to remove the paper sheet M from the peripheral surface of the rotary drum 10. The driving section DR is constituted such that a motion of the front-end clamping section is required as a condition for enabling a motion of the rear-end clamping section and the motions of the front end and rear-end clamping sections are synchronized to have a predetermined difference in the rotation amount of the rotary drum which corresponds to a distance between the front-end and rear-end clamping sections 41 and 51. The sheet holding system HL employs electrostatic suction holing and negative-pressure suction holding to be described later as auxiliaries to the mechanical paper sheet holding. In FIG. 2, rear-end clamping section 51 and a part of the driving section DR for the clamping section 51 are omitted so as to avoid complication.

The front-end clamping section 41 includes a front claw unit 42 set in the axial direction of the rotary drum 10 and driven by a front driving unit DRF. The front driving unit DRF has a front clamping mechanism 43 for setting the front claw unit 42 in a clamp state using the urging force of a spring 43SP, a front locking mechanism 44 for locking the front claw unit 42 into a release state against the urging force of the spring 44SP, an unlocking mechanism 45 for unlocking the lock of the front locking mechanism 44 using a force transmitted from an actuator 45A and the rotation of the rotary drum 10, and a lock resuming mechanism 46 for resuming the lock of the locking mechanism 44 using a force transmitted from an actuator 46A and the rotation of the rotary drum 10. The front claw unit 42, the front clamping mechanism 43 and the front locking mechanism 44 are fixed to an attachment plate 58 on one end side of the rotary drum 10. Further, the actuators 45A and 46A for the unlocking mechanism 45 and the lock resuming mechanism 46 are mounted on the housing 1 on the stationary side.

On the other hand, a rear-end clamping section 51 includes a rear claw unit 52 set in the axial direction of the rotary drum 10 and driven by a rear driving unit DRR. The rear driving unit DRR has a rear clamping mechanism 53 for setting the rear claw unit 52 in a clamp state using the urging forces of springs 53SP and 55SP, a rear locking mechanism 55 for locking the rear claw unit 52 into a release state against the urging force of the spring 53SP, an unlocking mechanism 59KA for unlocking the lock of the rear locking mechanism 55 using a force transmitted from the actuator 46A and the rotation of the rotary drum 10, and a lock resuming mechanism 59KB for resuming the lock of the rear locking mechanism 55 using a force transmitted from the actuator 46A and the rotation of the rotary drum 10. The rear claw unit 52, the rear clamping mechanism 53 and the rear locking mechanism 55 are mounted on the one end side of the rotary drum 10. Further, the actuators 45A and 46A for the unlocking mechanism 59KA and the lock resuming mechanism 59KB are mounted on the housing 1 on the stationary side.

Moreover, in this embodiment, the rear-end clamping section 51 is arranged such that a clamping operation of the rear claw unit 52 is enabled in a condition that the front claw unit 42 has performed a clamping operation, and a releasing operation of the rear claw unit 52 is enabled in a condition that the front claw unit 52 has performed a releasing operation.

The aforementioned components will be described in detail.

The front claw unit 42 has a plurality of clamp claws 42F, an engagement section 42C, and a sector gear 42G to hold the front end of the paper sheet M on the peripheral surface 11 of the rotary drum 10. The clamp claws 42F are mounted to rotatable about a pin 42P and hold the front end of the paper sheet M on the peripheral surface 11 of the rotary drum 10 by applying a pressure.

Figure 4:
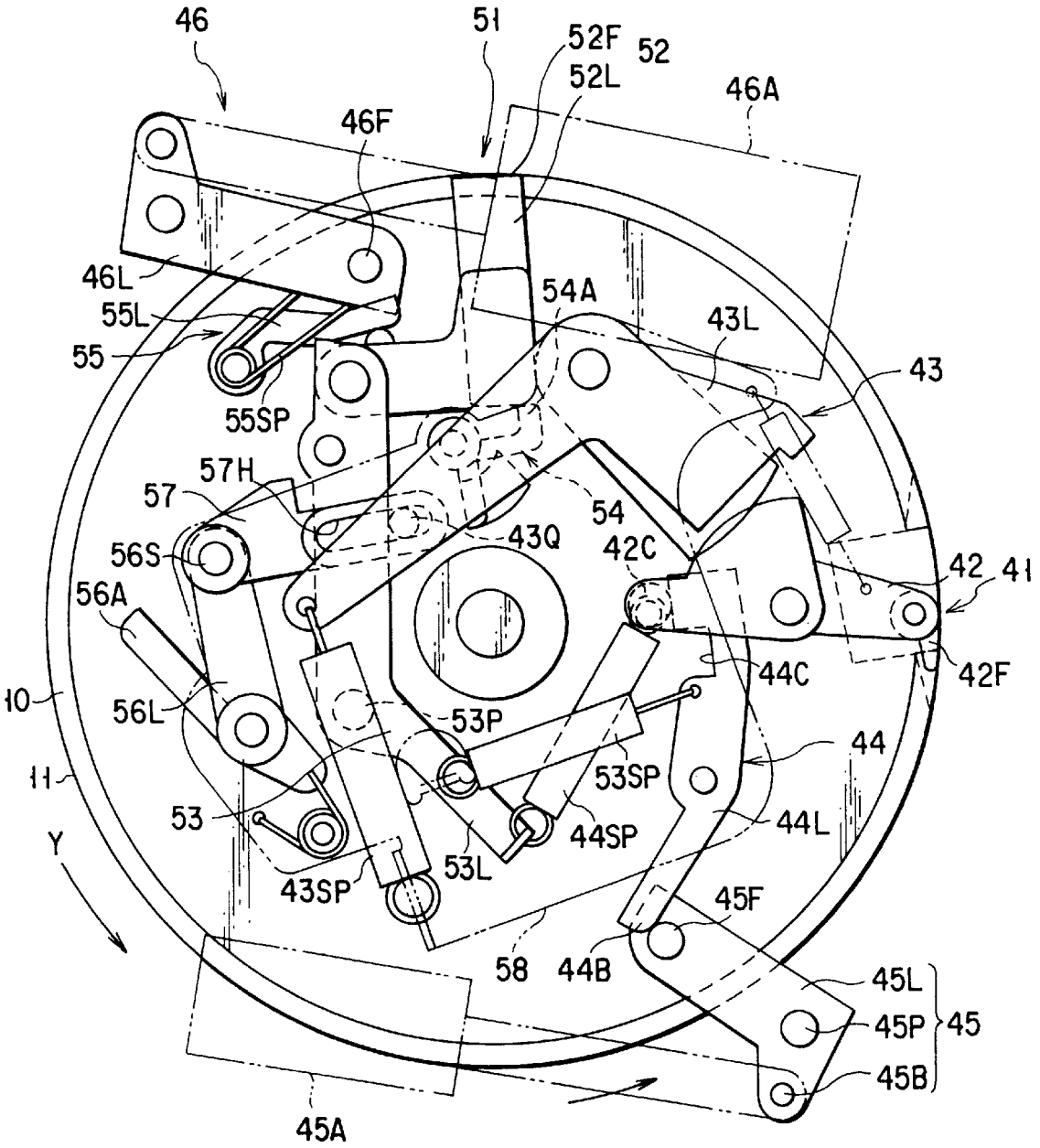
FIG. 4 is a view for explaining the clamp operation of a front clamp claw shown in FIG. 3.
Figure 5:
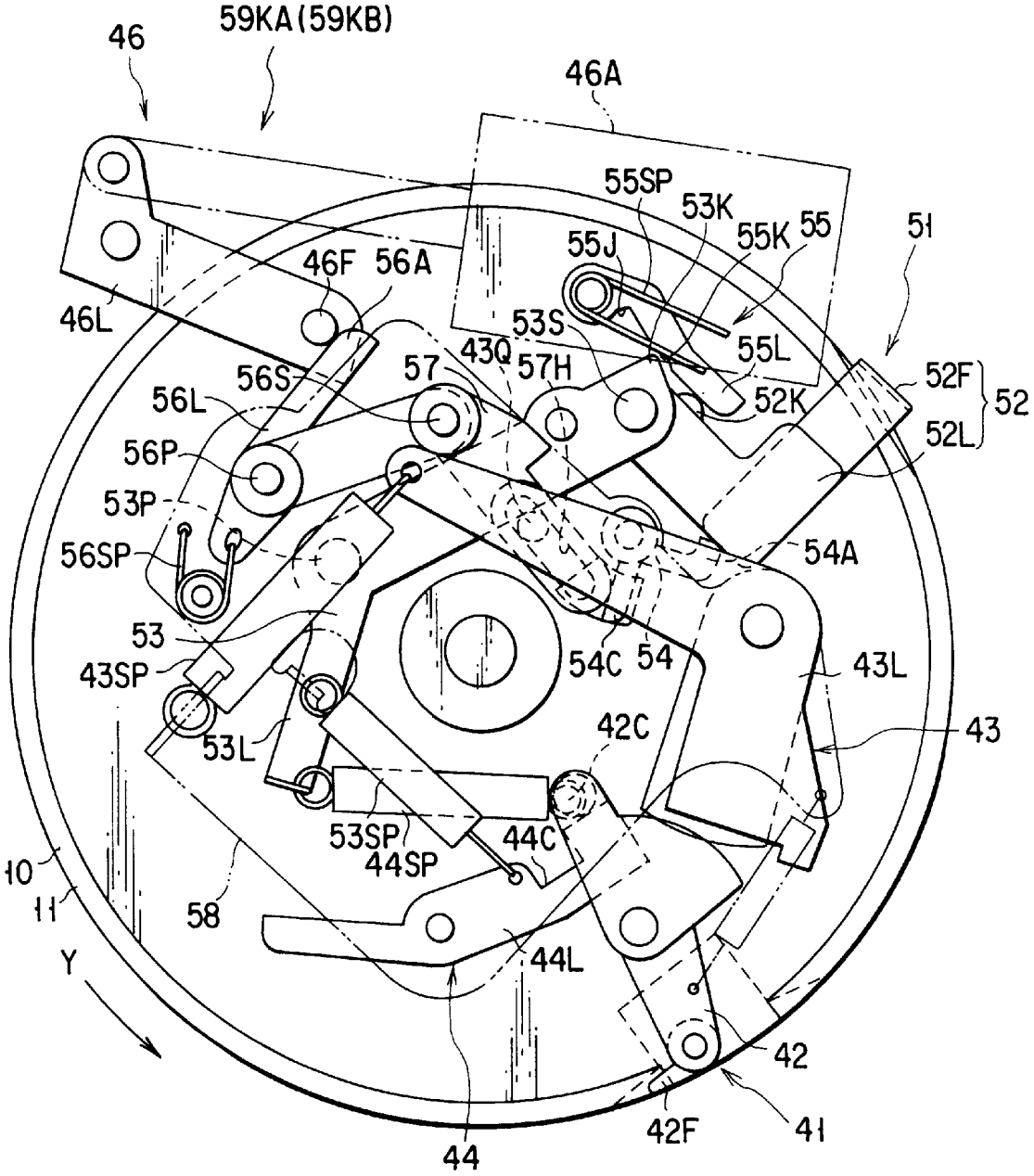
FIG. 5 is a view for explaining the clamp operation of a rear clamp claw shown in FIG. 3.
Figure 6:
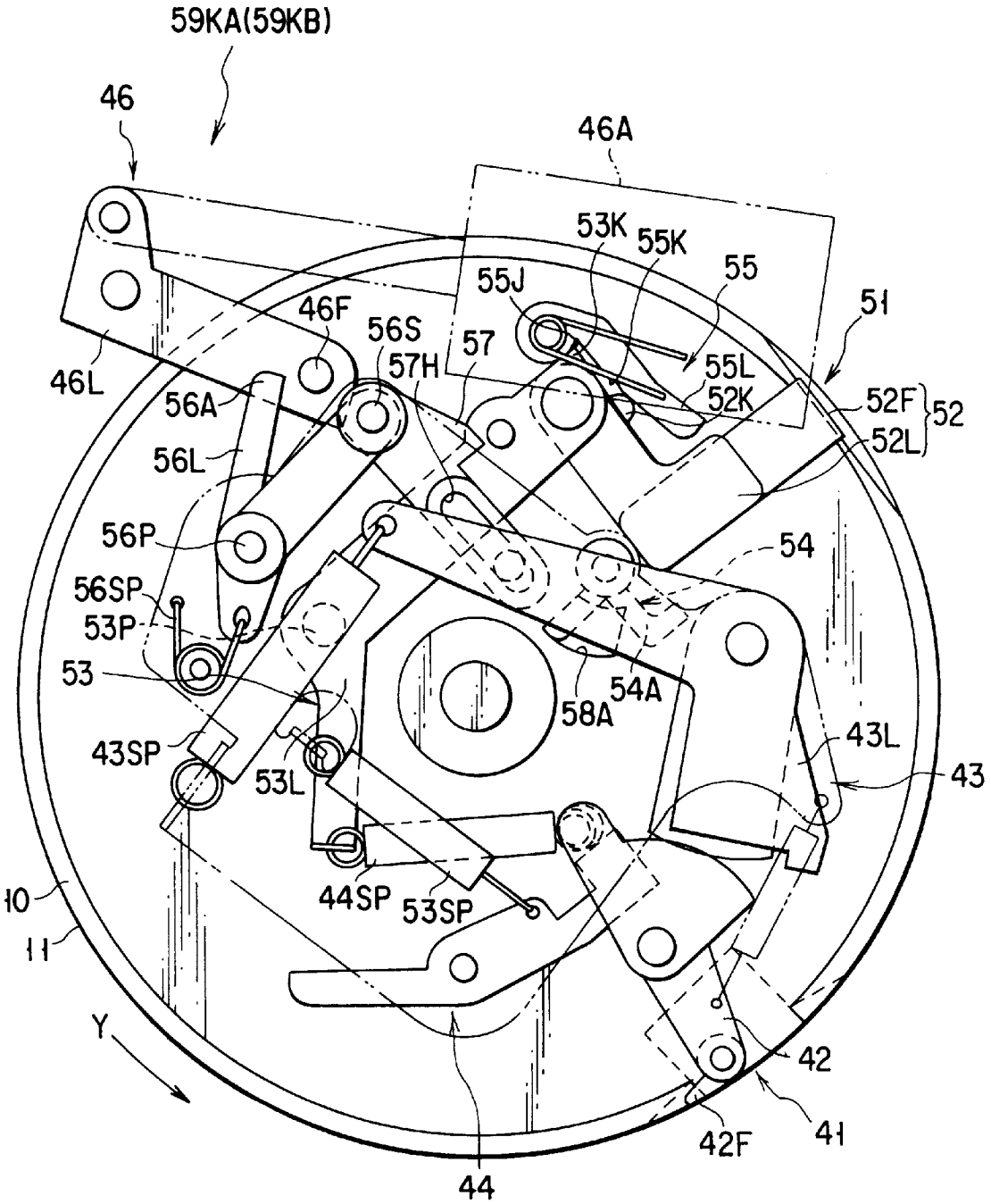
FIG. 6 is a view for explaining a state in which the rear clamp claw is set in a clamping position with the rotation of the rotary drum.

The front clamping mechanism 43 is constituted by a lever 43L rotatable about a pin 43P, a sector gear 43G disposed at a distal end portion of the lever 43L and engaged with the sector gear 42G, and a spring 43SP disposed between the a proximal end portion 43B of the lever 43L and a stationary section 43R. The mechanism 43 sets the front claw unit 42 in a clamp state as shown in FIGS. 4 to 6, using the urging or tensile force of the spring 43SP.

The front locking mechanism 44 is constituted by a lock lever 44L rotatable about a pin 44P, and a spring 44SP urging the lock lever 44L counterclockwise in FIG. 3. The lock lever 44L has an engagement recess 44C formed to be selectively engaged with the engagement section 42C of the front claw unit 42, so that the front claw unit 42 can be locked into a release state when the recess 44C and section 42C are engaged with each other.

The front unlocking mechanism 45 is constituted by a lever 45L (with a distal end portion 45F and a proximal end portion 45B) rotatable about a stationary-side pin 45P, and the actuator 45A. When the lever 45L is rotated clockwise about the pin 45P by the actuator 45A, a pin of the distal end portion 45F protrudes toward the axis of the rotary drum 10 and is engaged with a proximal end portion 44B of the lock lever 44L which approaches with the rotation of the rotary drum 10. At this time, the lever 44L is rotated clockwise and disengaged from the engagement section 42C of the front claw unit 42. Thus, the claw unit 42 is set in the clamp state by the urging force of the spring SP. In other words, the claw unit 42 is unlocked from the release state.

Figure 7:
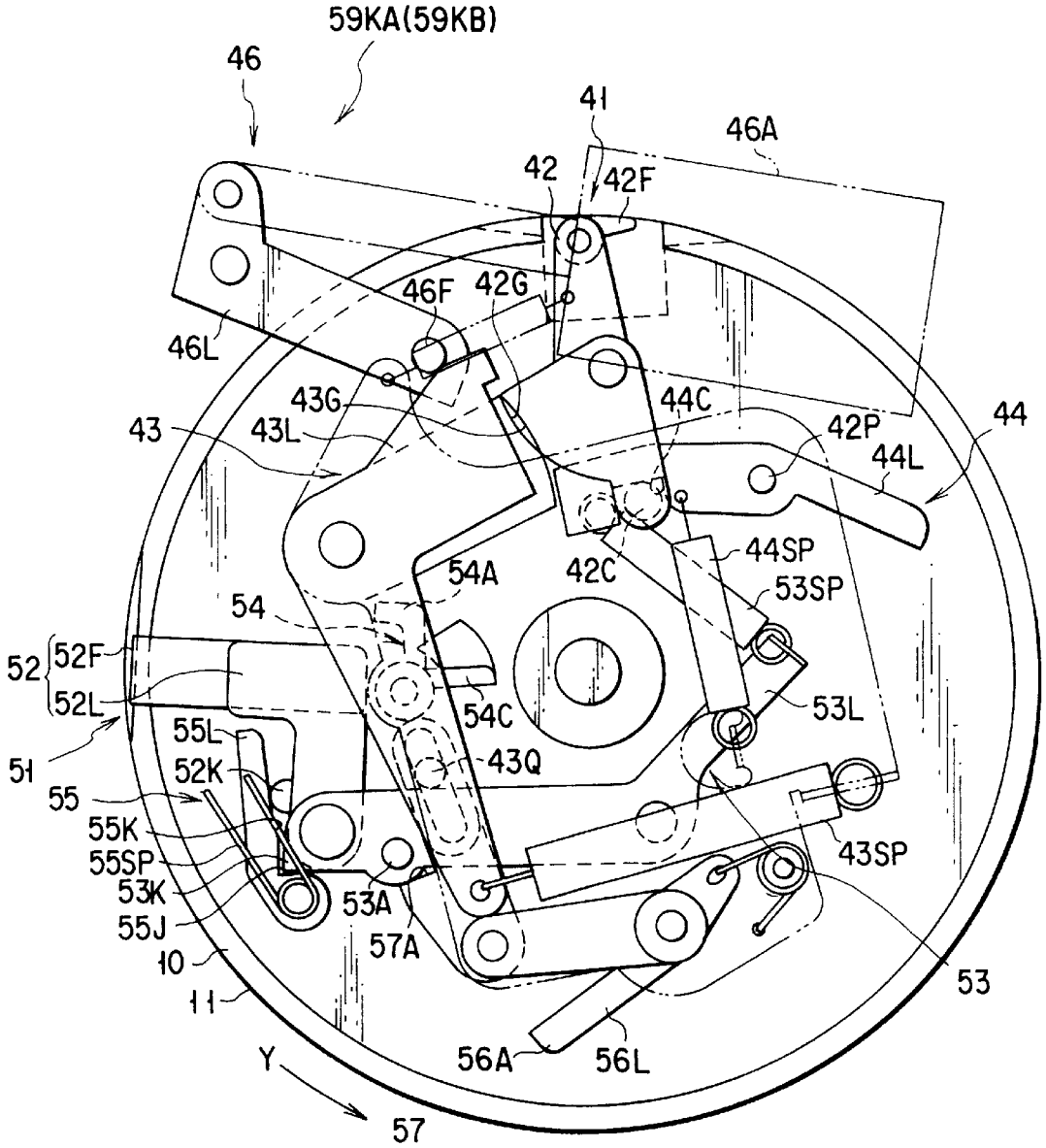
FIG. 7 is a view for explaining the release operation of the front clamp claw shown in FIG. 3.

As is shown in FIG. 3, the front lock resuming mechanism 46 is constituted by a lever 46L (with a distal end portion 46F and a proximal end portion 46B) rotatable about a stationary-side pin 46P, and the actuator 46A. When the lever 46L is rotated clockwise about the pin 46P by the actuator 46A, a pin of the distal end portion 46F of the lever 46 protrudes toward the axis of the rotary drum 10 as shown in FIG. 7, and is engaged with the lever 43L which approaches with the rotation of the rotary drum 10, thereby causing the front claw unit 42 into the release state via the sector gears 43G and 42G. As a result, the engagement section 42C of the front claw unit 42 is engaged with the engagement recess 44C of the lock lever 44L. In other words, the front claw unit 42 is resumed to the release state.

The rear claw unit 52 has a plurality of clamp claws 52F, a pair of claw holding members 52L, etc to hold the rear end of the paper sheet M on the peripheral surface 11 of the rotary drum 10. The holding members 52L are provided on one end side and the other end side of the rotary drum 10, and coupled with each other via a coupling rod (not shown) to operate simultaneously. The clamp claws 52F are aligned along the axial direction of the rotary drum 10, and coupled with distal end portions of the claw holding members 52L at both the ends of the rotary drum 10. Accordingly, the clamp claws 52F move on the peripheral surface of the rotary drum 10 by the movement of the claw holding members 52L. In FIGS. 3 to 8, only one end side of the rotary drum 10 is shown.

The rear clamping mechanism 53 has a lever 53L which is attached to the attachment plate 58 and rotatable about a pin 53P and whose distal end is rotatably coupled with a rear end portion of the claw holding member 52L via a coupling section 53S, a spring 53SP disposed between a rear end portion 53B and a stationary portion 53R of the lever 53L, a position regulating member 55L disposed rotatable about a pin 55P and having an engagement section 55J to be engaged with an engagement projection 53K which forms a distal end portion of the lever 53L, and a spring 55SP which can urge the position regulating member 55L clockwise in FIG. 3 to thereby press it against a projection 52K on the claw holding member 52L. Accordingly, the mechanism 53 is constituted such that the rear claw unit 52 is maintained in a clamp state as shown in FIGS. 6 and 7, using the urging forces of the springs 53SP and 55SP.

The rear locking mechanism 55 is constituted by an engagement recess 55K formed in the position regulating member 55L, and the spring 55SP. The mechanism 55 locks the clamp claw 52 into a release state shown in FIG. 3, by engaging the engagement recess 55K with the engagement projection 53K of the lever 53L using the urging force of the spring 55SP.

An engagement member 54 is attached to the attachment plate 58 and rotatable about a pin 54P, and has a position regulating section 54A and a pressure receiving section 54C. A portion of the pressure receiving section 54C is movably inserted in a sectoral opening 58A formed in the attachment plate 58.

The unlocking mechanism 59KA and the lock resuming mechanism 59KB are formed using at least one of the unlocking mechanism 45 and the lock resuming mechanism 46 of the front-end clamping section 41. In this embodiment, the mechanisms 59KA and 59KB are formed using the lock resuming mechanism 46 of the front-end clamping section 41, as is shown in FIGS. 5 to 8.

Specifically, the unlocking mechanism 59KA has the lock resuming mechanism 46 of the front-end clamping section 41, the lever 56L, a pressing member 57 and the engagement member 54. The unlocking mechanism 59KA is constituted such that the rear claw unit 52 is unlocked from the release state in a condition that the front claw unit 42 has been set in a clamp state.

Specifically, the lever 56L is attached to the attachment plate 58 and rotatable about a pin 56P, and is urged by a spring 56SP counterclockwise in FIG. 3. The lever 56L is formed in a forked shape and has an operating distal end portion 56A and a coupling end portion 56B which is rotatably coupled with the proximal end portion of the pressing member 57 via a coupling section 56S.

The pressing member 57 has a long hole 57H in which a pin 43Q fixed to the lever 43L of the front clamping mechanism 43 is movably inserted.

In the above-described structure, when the lever 46L is rotated about the pin 46P clockwise by the actuator 46A of the unlocking mechanism 59KA after the front end of the paper sheet M is clamped by the front clamp claws 42F as shown in FIGS. 5 and 6, a pin of the distal end portion 46F of the lever 46L is engaged with the operating distal end portion 56A of the lever 56L. At this time, the lever 56L is rotated about the pin 56P against the urging force of the spring 56SP, thereby causing the pressing member 57 to press the pressure receiving section 54C of the engagement member 54.

As a result, as shown in FIG. 3, the rear claw unit 52 is rotated counterclockwise about the coupling section 53S by the urging force of the position regulating section 54A, thereby disengaging the engagement projection 53K of the lever 53L from the engagement recess 55K. Then, the lever 53L is rotated by the urging force of the spring 53SP counterclockwise in FIG. 3, until the engagement projection 53K is engaged with the engagement section 55J of the position regulating member 55L. Where they are engaged with each other, the rear claw unit 52 is maintained at a position determined by the urging force of the spring 55SP. In other words, the rear claw unit 52 can be set in the clamp state.

Further, the lock resuming mechanism 59KB has the lock resuming mechanism 46 of the front-end clamping section 41, the lever 56L, a pressure receiving section 53A formed in the lever 53L and a press section 57A of the pressing member 57. The lock resuming mechanism 59KB is constituted such that the rear claw unit 52 is resumed into the release state in a condition that the front claw unit 42 has been set in the release state.

Figure 8:
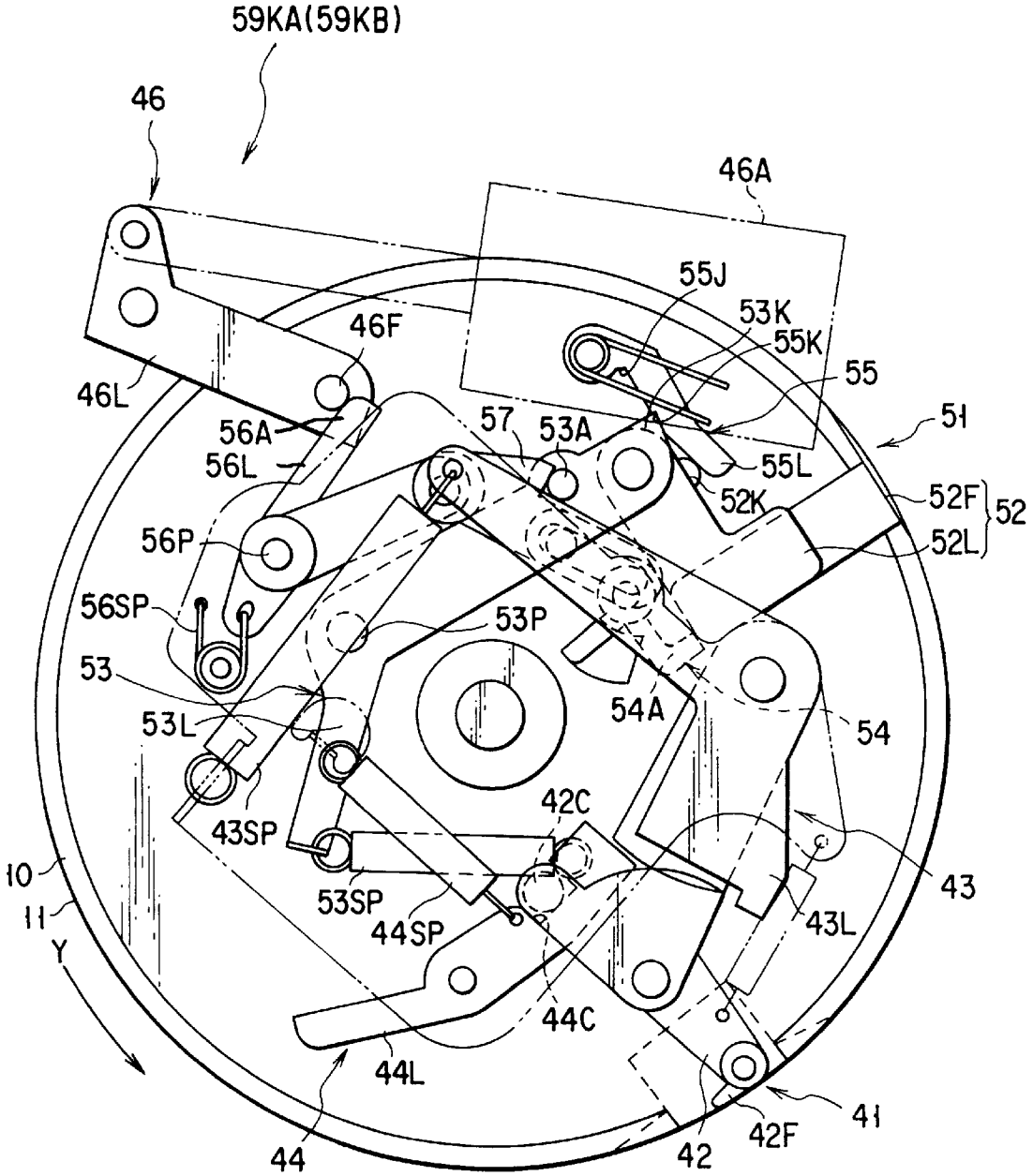
FIG. 8 is a view for explaining the release operation of the rear clamp claw shown in FIG. 3.

As is shown in FIG. 8, when the lever 46L is rotated clockwise about the pin 46P by the actuator 46A of the lock resuming mechanism 59KB after the front claw unit 42 is released from clamping the front end of the paper sheet M, a pin of the distal end portion 46F is engaged with the operating distal end portion 56A of the lever 56L which approaches with the rotation of the rotary drum 10.

Then, the lever 56L rotates clockwise, thereby engaging the press section 57A of the pressing member 57 with the pressure receiving section 53A of the lever 53L. As a result, the lever 53L rotates clockwise, thereby causing the engagement projection 53K of the lever 53L to be engaged with the engagement recess 55K. In other words, the rear claw unit 52 is resumed into the release state.

As shown in FIG. 1, the ink-jet printer includes a charging unit 101 serving as an auxiliary holding means and formed of a charging roller for electrostatic suction holding. The charging unit 101 charges the paper sheet M with positive charge so that the paper sheet M is held on the peripheral surface 11 of the rotary drum 10 by an electrostatic suction force created between the sheet M and the rotary drum 10 set at a ground potential. A supplementary charging unit 103 is used to supplement electrostatic force attenuated due to printing. A charge removing unit 105 is used to remove the electrostatic force by applying negative charge to the paper sheet M after printing.

Figure 9:
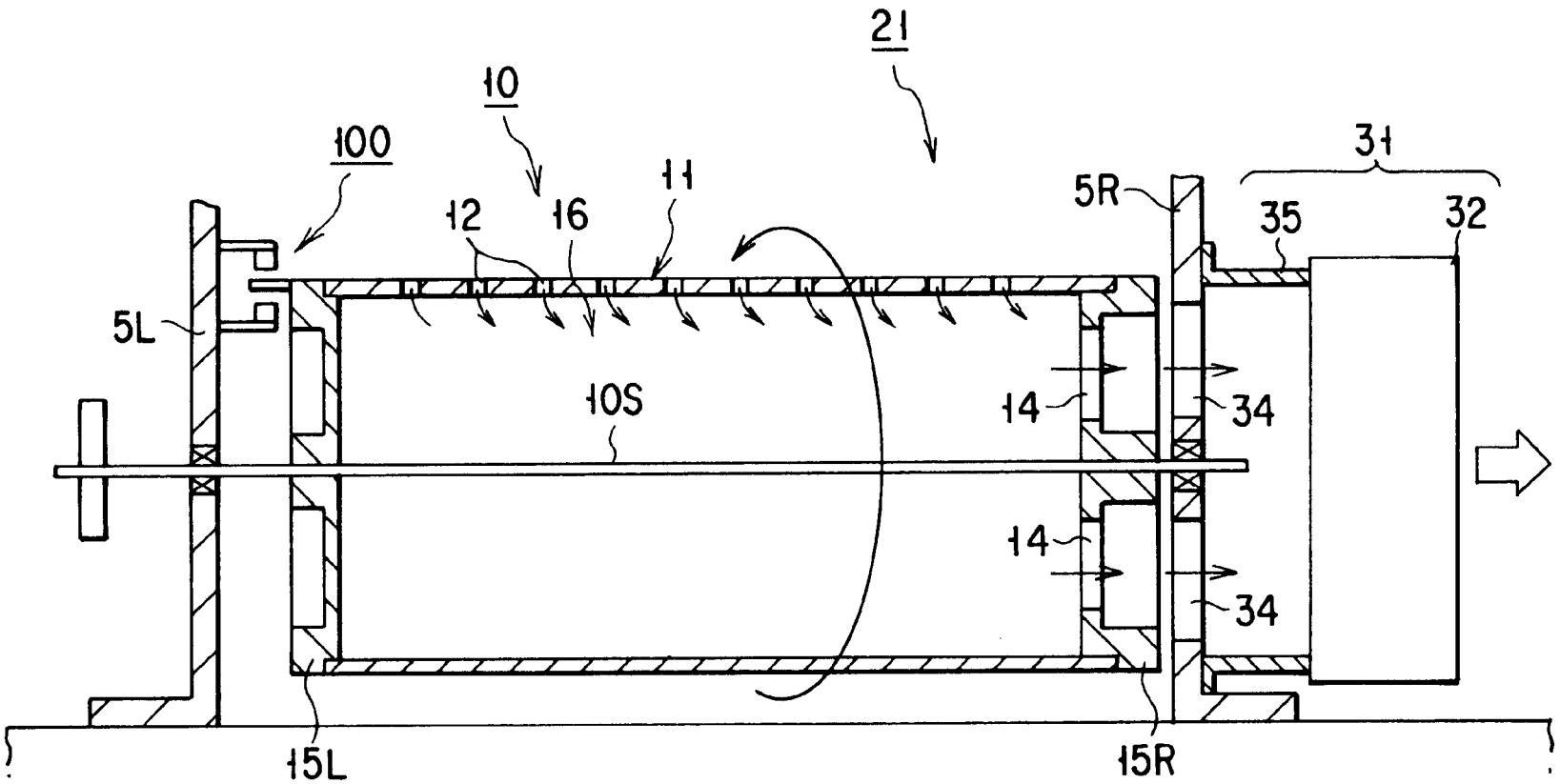
FIG. 9 is a view for explaining a negative-pressure suction holding unit incorporated as an auxiliary sheet holding system in the rotary drum shown in FIG. 2.

The ink-jet printer further includes a negative-pressure suction holding unit 21 serving as an auxiliary holding means. The negative-pressure suction holding unit 21 is constructed to hold the paper sheet M by creating negative pressure in the internal space 16 of the rotary drum 10 using a negative-pressure creating unit 31 shown in FIG. 9, and applying the negative pressure via multiple suction holes 12 which are formed through the rotary drum 10 in the radial direction.

The negative-pressure creating unit 31 includes a suction port 34 corresponding to a drum-side suction port 14, and a suction fan 32 for sucking air through the suction port 34 and a duct 35 to create negative pressure in the drum internal space 16.

The suction port 14 is formed in a side plate located at an end-surface 15R of the rotary drum 10, and the suction port 34 is fixedly formed in a bracket 5R in the housing 1 to face the suction port 14. The end-surface 15R of the rotary drum 10 and the bracket 5R of the negative-pressure creating unit 31 are set close to each other in the axial direction of the rotary drum 10 and not in contact with each other. Therefore, the rotation load of the rotary drum 10 can be reduced.

Further, a gap between the end-surface 15R and the bracket 5R is useful for suppressing variations in the load of the suction fan between the cases where the paper sheet M is held by negative pressure and not held by it. Another end-surface plate 15L is a blind plate.

In addition, The charging unit 101 formed of the charging roller for electrostatic suction holding and the negative-pressure suction holding unit 21 are not always necessary. The sheet holding system HL of this embodiment is able to hold the paper sheet M if the charging unit 101 and the negative-pressure suction holding unit 20 are eliminated.

The operation of the ink-jet printer will be described below.

A paper sheet M is loaded to the rotary drum 10 while it rotates. At the timing of loading the paper sheet M, the unlocking mechanism 45 of the front-end clamping section 41 operates to unlock the lock of the front locking mechanism 44 by the driving force of the actuator 45A and the rotation of the rotary drum 10. The front claw unit 42 is set in the clamp state by the urging force of the spring 43SP of the front clamping mechanism 43. As a result, the front end of the paper sheet M is reliably held between the front claw unit 42 and the peripheral surface 11 of the rotary drum 10.

The paper sheet M is not only held mechanically by the front claw unit 42, but also held using the negative pressure created in the internal space of the rotary drum 10 and applied through the suction holes 12 by the negative-pressure suction holding unit 21 and the electrostatic charge created by the charging unit 101 and the like.

The unlocking mechanism 59KA of the rear-end clamping section 51 operates with a predetermined delay time after the front end of the paper sheet M has been clamped by the front claw unit 42, so as to unlock the lock of the rear locking mechanism 55 by the driving force of the actuator 46A and the rotation of the rotary drum 10. The rear claw unit 52 is set in the clamp state by the urging force of the springs 53SP, 55SP of the rear clamping mechanism 53, thereby reliably holding the rear end of the paper sheet M on the peripheral surface 11 of the rotary drum 10, which rotates by an amount corresponding to the length of the paper sheet M during the predetermined delay time.

After the paper sheet M is held on the peripheral surface 11 of the rotary drum 10 as described above, the print head 200 performs printing for the paper sheet M by selectively ejecting inks from the nozzle units NU of four colors on the basis of print data.

After printing, the lock resuming mechanism 46 of the front-end clamping section 41 is operated so as to resume the lock of the front locking mechanism 44 by the driving force of the actuator 46A and the rotation of the rotary drum 10. The front claw unit 42 is moved against the urging force of the spring 43SP of the front clamping mechanism 43 and resumed into the release state. As a result, the front end of the paper sheet M is released from the peripheral surface 11 of the rotary drum 10.

The lock resuming mechanism 59KB of the rear-end clamping section 51 is operated with the predetermined delay time after the front end of the paper sheet M has been released by the front claw unit 42, so as to resume the lock of the rear locking mechanism 55 by the driving force of the actuator 46A and the rotation of the rotary drum 10. The rear claw unit 52 is moved against the urging force of the springs 53SP, 55SP of the rear clamping mechanism 53 and resumed into the release state, thereby releasing the rear end of the paper sheet M. At this time, negative-pressure suction holding by the negative-pressure suction holding unit 21 and electrostatic suction holding by the charging unit 101 and the like are also terminated.

When the printed paper sheet M has been released and removed from the rotary drum 10, the paper sheet M is fed to discharge into the tray 192 or 193 via the paper sheet feed-out mechanism 160, for example.

According to the embodiment described above, the ink-jet printer includes the front-end clamping section 41 for clamping the front end of the paper sheet M on the peripheral surface of the rotary drum 10 by the front claw unit 42, and the rear-end clamping section 51 for clamping the rear end of the paper sheet M. Since the front and rear ends of the paper sheet M are clamped, the paper sheet M can be reliably held on the rotary drum 10 while the drum rotates, and released therefrom after printing. Thus, high-speed printing and high-quality printing can be obtained. Moreover, the ink-jet nozzles 207 of the nozzle units NU can be prevented from being damaged by the rear portion of the paper sheet M which rises from the peripheral surface 11 of the rotary drum 10 and collides with the ink-jet nozzles 207.

Also, since the front and rear claw units 42 and 52 are changed between the clamp state and the release state using the rotation of the rotary drum 10, no driving force generating mechanism for driving the claw units 42 and 52 is required to be incorporated in the rotary drum 10. Therefore, the rotation load of the rotary drum 10 can be reduced.

In addition, since the unlocking mechanism and the lock resuming mechanism are commonly used for controlling each of the front-end and rear-end clamping sections 41 and 51, the required number of components can be reduced. Accordingly, the size and cost can be further reduced.

The rear claw units 52 of the rear-end clamping section 51 is arranged to perform a clamping operation in a condition that the front claw unit 42 has performed a clamping operation, and a releasing operation in a condition that the front claw unit 52 has performed a releasing operation.

For example, when the front claw unit 42 is in the release state, the rear-end clamping section 51 can not be set in the clamp state. In FIG. 3, when the lever 43L rotates clockwise (the releasing operation of the front claw unit 42), the pressing member 57 rotates counterclockwise about coupling section 56S according to the positional relationship between the pin 43Q fixed to the lever 43L and the long hole 57H of the pressing member 57. Since the distal end portion of the pressing member 57 (right side of FIG. 3) does not face the pressure receiving section 54C of the engagement member 54, the pressure receiving section 54C of the engagement member 54 cannot be pressed even if the distal end portion of the pressing member 57 (right side of FIG. 3) is moved right in FIG. 3 by the actuator 46A. Therefore, the pressure receiving section 54C does not rotate to rotate (or move) the rear claw unit 52. That is, if the front claw unit 42 is not in the clamp state, the rear claw unit 52 does not perform clamping operation since the pressure receiving section 54C is not pressed in response to movement of the pressing member 57 caused by the actuator 46A.

Further, when the front claw unit 42 is in the clamp state, the rear claw unit 52 can not be set in the release state. In FIG. 3, when the lever 43L rotates counterclockwise (the clamping operation of the front claw unit 42), the pressing member 57 rotates clockwise about coupling section 56S according to the positional relationship between the pin 43Q fixed to the lever 43L and the long hole 57H of the pressing member 57. Since the press section 57A of the pressing member 57 does not face the pressure receiving section 53A of the lever 53L, the pressure receiving section 57A of the lever 53L cannot be pressed even if the press section 57A of the pressing member 57 is moved right in FIG. 3 by the actuator 46A. Therefore, the lever 53L does not rotate to rotate (or move) the rear claw unit 52. That is, if the front claw unit 42 is not in the release state, the rear claw unit 52 does not perform releasing operation since the pressure receiving section 53A of the lever 53L is not pressed in response to movement of the pressing member 57 caused by the actuator 46A.

For example, in a case where the power is turned off during printing and the paper sheet M is left on the rotary drum 10, the clamping of the rear end of the paper sheet M is not released, irrespective of the angular position of the rotary drum 10 (i.e. the position in which the paper sheet M is held), before the clamping of the front end is released, even if the power is turned on again and the lever 56L is engaged, by initial processing, with the distal end portion 46F of the lever 46L before the lever 43L is engaged with it. Accordingly, occurrence of jam of the paper sheet M due to the rise of its rear portion, or damage due to collision of the paper sheet with each nozzle unit NU can be avoided. The rear end of the paper sheet M is not clamped before the front end of the paper sheet M. Therefore, the occurrence of jam can be more reliably prevented.

Even when the front claw unit 42, but not the rear claw unit 52, is released from its clamping operation during manual elimination of a jam (for example, where the rear portion of the jammed sheet is pulled between the rear claw unit 52 and the drum peripheral surface 11), or even when the rotary drum 10 stops rotating because of power off, for example, after the front end of the paper sheet M is released and before the rear end portion is completely released, the distal end portion (pin 46F) of the lever 46L can be engaged upon turn on of the power, irrespective of the angular position of the rotary drum 10, with the distal end portion 56A of the lever 56L which has moved thereto with the rotation of the rotary drum 10, to release the rear claw unit 52, by driving the actuator 46A to protrude the pin 46F of the lever 46L toward the axis of the rotary drum 10.

Therefore, it is not necessary during initialization to detect the home position of the rotary drum 10 and control the protrusion timing of the distal end portion (pin 46F) of the lever 46L on the basis of the detection result, which can reduce the load on the control circuit and the time required for the initialization.

Furthermore, there are provided, as auxiliary means, the charging unit 101 and the supplementary charging unit 103 for electrostatically attaching the paper sheet M to the rotary drum 10, and the negative-pressure suction holding unit 21 for attaching the paper sheet M to the rotary drum 10 by negative pressure. Accordingly, the paper sheet M can be more reliably attached to and separated from the rotary drum 10.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. An ink-jet printer comprising:

a rotary drum which rotates at a constant speed;

a medium holding system which holds a printing medium on the rotary drum;

a print head arranged to print an image by jetting ink onto a printing medium which is held on the rotary drum by the medium holding system and which rotates along with the rotary drum, while the rotary drum makes a predetermined number of rotations during a printing operation, wherein the predetermined number is greater than one;

wherein the medium holding system includes:

a front-end clamping section, disposed on the peripheral surface of the rotary drum, for clamping a front end of the printing medium;

a rear-end clamping section set apart from the front-end clamping section in a rotational direction of the rotary drum along the peripheral surface of the rotary drum, for clamping a rear end of the printing medium; and a driving section for driving the front-end clamping section and the rear-end clamping section to clamp the printing medium on the peripheral surface of the rotary drum during one rotation of the rotary drum made before printing of the image is initiated and to release the printing medium from the peripheral surface of the rotary drum during another rotation of the rotary drum made after printing of the image is completed; and the driving section is arranged such that a motion of the rear-end clamping section is mechanically enabled by a motion of the front-end clamping section after a rotation amount of the rotary drum which corresponds to a distance between the front-end and rear-end clamping sections.

2. An ink-jet printer according to claim 1, wherein the driving section comprises front-end and rear-end clamping section driving mechanisms each of which includes:

a clamping mechanism for setting a corresponding one of the front-end clamping section and the rear-end clamping section into a clamp state; using an urging force of a spring;

a locking mechanism for locking, against the urging force of the spring, the corresponding one of the clamping sections in a released state;

an unlocking mechanism for unlocking a lock of the locking mechanism, using a driving force of a first actuator and rotation of the rotary drum, and a lock resuming mechanism for resuming the lock of the locking mechanism, using a driving force of a second actuator and rotation of the rotary drum.

3. An ink-jet printer according to claim 2, wherein the unlocking mechanisms and the lock resuming mechanisms of the front-end and rear-end clamping section driving mechanisms are provided in the form of one component commonly used.

4. An ink-jet printer according to claim 1, wherein each of the front-end clamping section and the rear-end clamping section includes a plurality of clamp claws aligned in an axial direction of the rotary drum.

* * * * *